United States Patent [19]

Smura

[11] 4,170,535

[45] Oct. 9, 1979

[54] MEMBRANE SECURING DEVICE

[75] Inventor: Bronislaw B. Smura, Marcellus, N.Y.

[73] Assignee: Allied Chemical Corporation, Morristown, N.J.

[21] Appl. No.: 863,389

[22] Filed: Dec. 22, 1977

[51] Int. Cl.[2] ..... C25B 9/00

[52] U.S. Cl. ..... 204/279; 204/295

[58] Field of Search ..... 204/279, 295, 296, 252

[56] References Cited

U.S. PATENT DOCUMENTS

| | | | |
|---|---|---|---|
| 2,867,575 | 1/1959 | DeJong | 204/296 |
| 3,335,079 | 8/1967 | Nellen | 204/279 X |

FOREIGN PATENT DOCUMENTS

| | | | |
|---|---|---|---|
| 672398 | 5/1952 | United Kingdom | 204/295 |
| 901305 | 7/1962 | United Kingdom | 204/295 |

*Primary Examiner*—John H. Mack
*Assistant Examiner*—D. R. Valentine
*Attorney, Agent, or Firm*—Thomas D. Hoffman; Anthony J. Stewart

[57] ABSTRACT

A securing device is disclosed which retains membranes in electrolytic cells during assembly and disassembly thereof and which allows safe, effective storage during disassembly of the cell.

3 Claims, 2 Drawing Figures

MEMBRANE SECURING DEVICE

BACKGROUND OF THE INVENTION

1. Field of the Invention

This invention relates to a device for securing membranes and more specifically, to a device which holds membranes securely in place during their installation into and removal from an electrolytic cell.

2. Description of the Prior Art

It is well known in the prior art that ion-permselective membranes are effectively used in electrolytic and electrodialytic cells. These membranes are retained in the cell between the anode and cathode compartments by the compressive force exerted on the cell frames when the cell is completely assembled, usually as a bank of a plurality of cells. During disassembly thereof, e.g., when routine maintenance or other repair of the cells is necessary and the compressive force is removed, the membranes are no longer secured and unless appropriate measures are taken they can readily fall between the cell frames resulting in creasing or wrinkling thereof. Creasing or wrinkling of the delicate membrane surface is to be avoided since this results in mechanical failure and ion leakage in the immediate vicinity of the failure, and their ability to be reused is impaired. In addition, membranes swell in aqueous electrolytes and storage in an appropriate medium is required during the time that they are removed from the cell to prevent damage to the integrity of swollen membranes by contractive drying.

Accordingly, it is an object of this invention to provide a device for securing membranes in electrolytic cells.

It is a further object of this invention to provide a chemically inert, rigid or semi-rigid membrane securing device which permits safe handling and storage of these fragile membrane sheets without mechanical or chemical damage thereto during prolonged periods of cell disassembly.

These and other objects will become apparent from the description which follows.

SUMMARY OF THE INVENTION

According to the present invention, an apparatus adapted to retain a membrane within an electrolytic cell is provided which comprises an elongated, hollow, cylindrical member composed of a rigid or semi-rigid, essentially chemically inert, non-conducting material having a substantially smooth outer surface, and a continuous open slit running the length of said member. On both ends of said member, a circular cap is located whereby a membrane held within said slit is prevented from being withdrawn from said member, at least one of said caps, preferably both, being removably mounted on the end of said member. The member and caps are constructed of a rigid or a semi-rigid, essentially chemically inert substance, preferably, polyvinyl chloride which is chemically inert to the strong alkaline and acidic electrolytes required in electrolytic or electrodialytic cells.

When membranes are mounted in an electrolyzer, it is advantageous to hold them in place by some means during the periods when cell frames and membranes are not compressed together thereby preventing the opportunity for damage to occur. In accordance with the present invention, a non-conducting semi-rigid slotted tubular device is provided which rests on the upper portion of either side of the cell frame. When the compressive force is removed, the securing device of the present invention prevents the membrane sheet from slipping down between the cell frames which almost invariably would result in wrinkles or creases in the membrane. Membrane sheets secured in accordance with the present invention can be easily handled during installation into, or removal from the cell, without wrinkling or creasing the membrane, by grasping the ends of the securing device and moving it vertically upward out of the cell or downward into the cell. Ion permselective, especially anionic permselective membranes, are very crease sensitive, that is, creasing results a mechanical failure of the membrane in the immediate vicinity of the crease such that leakage of counter-ions occurs, thereby effecting unacceptable contamination of the product solutions in the electrolyzer when it is reinserted and reused in a cell.

Also, membranes swell after immersion in water or electrolytes, i.e., when used in an electrolytic cell. Thus, it is important that the membranes be kept constantly wet after their initial installation in the electrolyzer, especially during periods when the membranes are temporarily removed therefrom. Upon removal from the cell, therefore, the membranes must constantly be wetted during that period of time in order thay they be effectively reusable when replaced in the cells after the repair or maintainence operation. In accordance with the present invention, the securing device has an essentially smooth outer surface on which the fragile membrane sheet can be rolled without creasing or wrinkling and thereafter totally immersed in a water or electrolytic bath to prevent the membrane from drying out while it is removed from the cell.

DETAILED DESCRIPTION OF THE INVENTION

Figure 1:
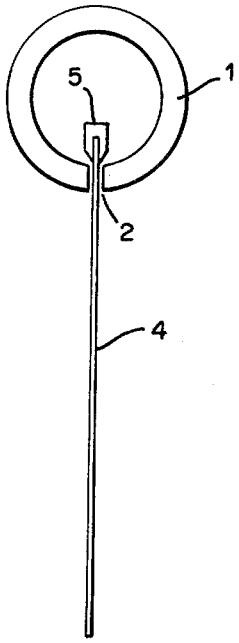
Figure 2:
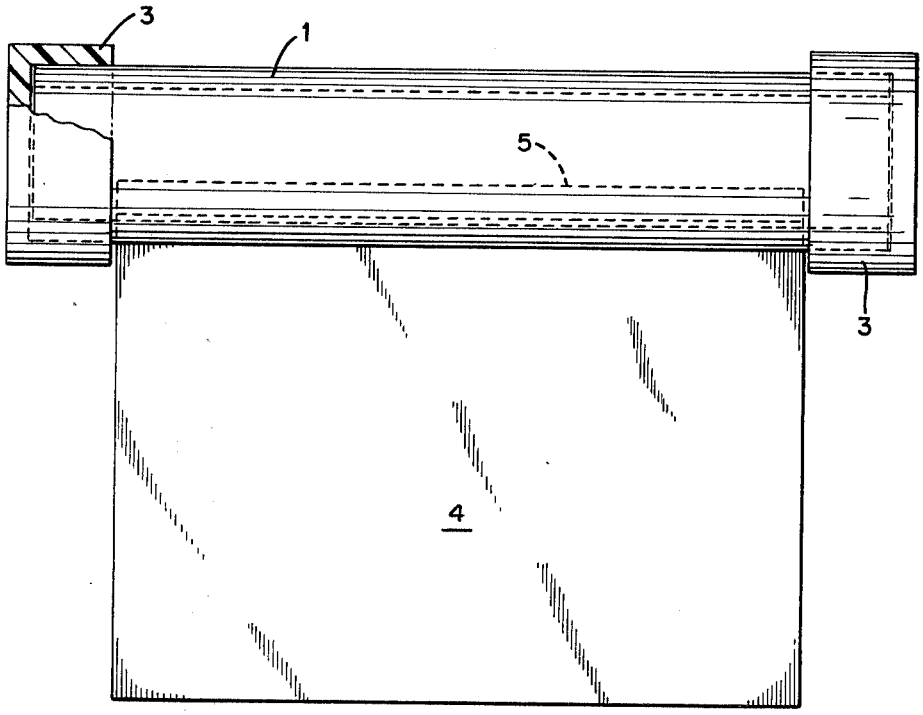

The membrane securing device of the present invention is depicted in the attached drawings. FIG. 1 is an end view of the slotted semi-rigid tube 1, usually at least 1 inch, preferably at least 2 inches in diameter, and with a length slightly longer than the full width of the membrane sheet 4. To the upper edge of the membrane 4there is attached strip 5 of a suitable semi-rigid plastic material which is stapled or otherwise attached to the edge of the membrane sheet. The thickness of the strip 5 is substantially greater than the width of the slot 2 in the tube thereby preventing the membrane from falling. Edges of the slot should be smooth to avoid membrane damage. It has been found that a slot width of at least about 0.03 inches is generally sufficient to retain any membrane, even fused, bipolar membranes. The membrane edge is inserted initially into the slot 2 in the tube from one end which is open, and drawn sideways until it is fully secured along the entire edge as depicted in FIG. 2. Each end of the slotted tube is fitted with a cap 3 to prevent the tube from slipping off the membrane. At least one of the caps is removably mounted on the end of the tube by friction or appropriate thread means which would be obvious to one skilled in the art. Preferably, both caps are so removably mounted. It is important that the distance between the end of the mounted cap and the lateral edge of the membrane sheet be minimized to substantially eliminate mechanical failure caused by lateral movement of the membrane sheet in the slot. In accordance with the present invention the caps are so mounted on the sloted tube to be supported by the top edge of the electrolyzer and thereby retain the membrane sheets between the cell frames even when the compressive force applied to the cell bank is released. Alternately, recesses in the top of both electrolyzer walls can be provided to prevent lateral movement of the securing device during the removal of or initiation of the compressive force in disassembly or assembly of the cell.

When routine cleaning or maintenance of the cell is required, the compressive force can be released and individual membranes be removed, without altering the position of the membranes, which are not required to be removed, by grasping both caps at the ends of the securing device and removing the membrane unit in a smooth vertical direction. The membrane sheet can be held more easily in a single plane by the present invention and the potential for unacceptable creasing encountered heretofore is substantially reduced. When the membranes must remain out of the electrolyzer for prolonged periods, the membrane sheets can readily be wound on the essentially smooth outer surface of the securing device into a conveniently handled package by hand rolling while gripping the caps and the whole compact membrane assembly stored in an appropriate aqueous solution. By providing a safe, efficient way of storing swollen membranes, their service life is significantly extended. When reassembly of the electrolyzer is desired these operations are reversed and the membrane sheet is unwound to its full extension. Direct handling of the membrane is thereby avoided. When securing membrane in accordance with the present invention, creasing and mechanical failure caused by inadequate storage is virtually eliminated. By substantially reducing mechanical failure of these fragile membranes, the potential of ion migration through malfunctioning membranes and the contamination of product solutions recovered from the electrolytic cells are significantly reduced. The economic advantage of the substantial extension in the effective service life of the permselective membranes is obvious.

I claim:

1. An apparatus adapted to retain a membrane within an electrolytic cell comprising an elongated, hollow, cylindrical member composed of a rigid or semi-rigid, essentially chemically inert, non-conducting material, having a substantially smooth outer surface, a continuous open slit running the length of said member, both ends of said member having located thereon a cap whereby a membrane held within said slit is prevented from being withdrawn from said member, at least one of said caps being removably mounted on the end of said member.

2. An apparatus as described in claim 1 wherein both of said caps are removably mounted on said member.

3. An apparatus as described in claim 1 wherein the material is polyvinyl chloride.

* * * * *